US005947760A

United States Patent [19]

Gemperli

[11] Patent Number: 5,947,760

[45] **Date of Patent: *Sep. 7, 1999**

[54] CONTACTING ARRANGEMENT FOR MULTICORE FLAT CABLES

[75] Inventor: Christoph Gemperli, Frauenfeld, Switzerland

[73] Assignee: Baumer Electric AG, Frauenfeld, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/759,035

[22] Filed: Dec. 2, 1996

[30] Foreign Application Priority Data

Dec. 12, 1995 [CH] Switzerland ..... 03505/95

[51] Int. Cl.[6] ..... H01R 9/09; H01R 4/24

[52] U.S. Cl. ..... 439/405; 439/498

[58] Field of Search ..... 439/405, 402, 439/403, 498, 67, 77, 492

[56] References Cited

U.S. PATENT DOCUMENTS 5,041,009 8/1991 McCleerey ..... 439/405

FOREIGN PATENT DOCUMENTS 356025 2/1990 European Pat. Off. ..... 439/405

43 20 327 6/1994 Germany .

OTHER PUBLICATIONS

ZVEI brochure, *Steckverbinder* Ideen mit Zukunft, pp. 8 and 9 with front and back covers, Oct. 1993.

*Primary Examiner*—Gary F. Paumen

*Attorney, Agent, or Firm*—Walter C. Farley

[57] ABSTRACT

A contacting apparatus for interconnecting first and second groups of conductors has a first group of conductors lying in a plane parallel with a longitudinal axis. A first conductor is spaced a first distance from the axis. A second conductor has a first portion spaced a second distance from the axis, the second distance being greater than the first distance, and a second portion on an opposite side of the axis from the first portion and spaced from the axis by a distance equal to the second distance. The first and second portions are electrically connected together. A connection module has a second longitudinal axis and contact points for making electrical connections with the conductors of the first group. The contact points include a first contact point spaced from the second longitudinal axis by a distance equal to one of the first and second distances, and second and third contact points on opposite sides of the second longitudinal axis and spaced from the second axis by distances equal to the other of the first and second distances. A second group of conductors includes a third conductor electrically connected to the first contact point and a fourth conductor electrically connected to both of the second and third contact points. The connection module is mechanically coupled to the first group of conductors with the first and second axes substantially aligned in either of two positions separated by 180°.

17 Claims, 4 Drawing Sheets

CONTACTING ARRANGEMENT FOR MULTICORE FLAT CABLES

FIELD OF THE INVENTION

The invention relates to an arrangement for the electrical contacting of a first group of conductors to the ends of a second group of conductors. It can in particular be used for the contacting of bus cables and power supply cables for the purpose of interlinking sensors and/or actuators.

BACKGROUND OF THE INVENTION

Interlink sensors and/or actuators are now used in numerous ways in various fields, e.g. in the machine and plant industry. The sensors and/or actuators are interlinked by means of a bus system. In order to reduce cabling costs, the bus cable should be brought as close as possible to the sensors. This gives rise to the requirement that the connection corresponds to protection class IP 65 (DIN 40050). The bus cable is typically a two-core, shaped flat cable. Apart from the bus cable, in those uses where several actuators with high power requirements are used, there is also a need for at least one separate, also shaped power supply cable.

The sensors and/or actuators are normally connected by means of at least one coupling module to the bus and the power supply. The coupling module can be installed at random points of the bus system and has cutting contacts for contacting the bus and power supply cable. There are passive and/or active electronic elements within the coupling module. Said elements can e.g. be constituted by an integrated circuit (IC), which converts the serial information transmitted in the bus into the parallel information required in the sensors and/or actuators and vice versa. The IC can also perform other data processing functions.

The individual sensors and/or actuators are connected by means of individual connecting cables to the coupling module. It is desirable for an optimum flexible and user-friendly design, to be able to connect the connecting cables from one or other side to the coupling module. This possibility has not existed in the hitherto known systems. Conventional coupling modules can only be fitted in a specific orientation to the bus and power supply cable, so as to prevent the cable being incorrectly contacted (e.g. with reverse polarity) or not contacted at all. This amounts to a significant restriction with respect to the use of such bus systems.

SUMMARY OF THE INVENTION

An object of the invention is to provide a contacting arrangement for contacting a first group of conductors, which are e.g. housed in fixed, multicore flat cables, to the ends of a second group of conductors, e.g. housed in a movable coupling module, the conductors of the second group, e.g. as connecting cables, being leadable away from the contacting arrangement in an opposite direction in each case.

The basic idea of the invention is that conductors to be contacted together are double guided in at least one of the two groups and are electrically interconnected. This permits two different contacting positions. In a first contacting position one of the double guided conductors is contacted and the other is possibly inactive or "blind". In a second contacting position the other of the other guided contactors is contacted. As a result of the double guided conductors being electrically interconnected, an electrical contacting is ensured in both contacting positions.

It is necessary for the conductors of the first group to run parallel to one another in one plane. The double guided conductors must be arranged symmetrically to a longitudinal axis. Two contacting positions are then possible and essentially result from a point reflection or a rotation by 180°, the symmetry or rotation center being located on the longitudinal axis. Thus, conductors of the second group can be led away from the contacting arrangement in two directions differing by 180°.

BRIEF DESCRIPTION OF THE DRAWINGS

Hereinafter a description is given of the prior art on the one hand and the contacting arrangement according to the invention on the other with reference to the attached drawings, wherein.

DESCRIPTION OF PREFERRED EMBODIMENTS

Figure 1:
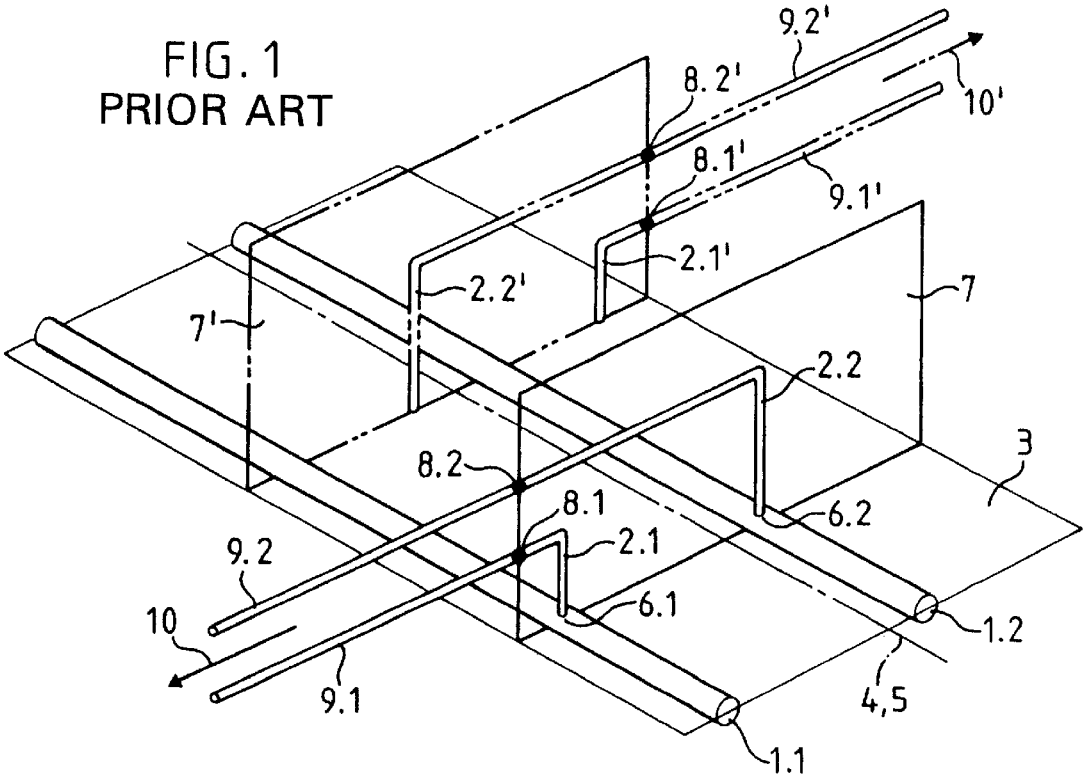
FIG. 1 PRIOR ART
FIG. 1 is a perspective view of a portion of a prior art contacting arrangement.

FIG. 1 diagrammatically illustrates the prior art and the problems associated therewith. A first group 1 of e.g. two electrical conductors 1.1, 1.2, must run in a plane 3 and parallel to a first longitudinal axis 4. They are to be electrically contacted by means of contacts 6.1, 6.2 at the ends of a second group 2 of conductors 2.1, 2.2, which are positioned about a second longitudinal axis 5. The first longitudinal axis 4 and second longitudinal axis 5 always coincide, i.e. are superimposed, if the two groups 1, 2 of conductors are connected with one another. FIGS. 1 to 4 show this connected state.

A coupling module 7, in which are housed the ends of the second group 2 of conductors 2.1, 2.2, is symbolically represented by a frame in FIGS. 1 to 4. The coupling module 7 has connections 8.1, 8.2 for connecting cables 9.1, 9.2, which e.g. lead to not shown sensors and/or actuators. For reasons of simplicity in FIGS. 1 to 4 direct connections are shown in the coupling module 7 between the contacts 6.1, 6.2 and the connections 8.1, 8.2. However, the coupling module 7 can also have different, not shown, passive and/or active electronic elements, e.g. an IC, which converts the serial information transmitted in the bus into the parallel information required in the sensors and/or actuators and vice versa. Such an IC can also perform other data processing functions.

The conductors 2.1, 2.2 of the second group 2 or their extensions 9.1, 9.2 can extend away in a given direction 10. Let us assume that it is now desirable to be able to cause the connecting cables 9.1, 9.2 to extend away in a second direction 10', which is e.g. opposite to the first, i.e. so as to permit contacting in a second contacting position. By turning the second group 2 of conductors by 180° and fitting in this position, as indicated in broken line form in FIG. 1, this cannot generally be achieved, because the ends of the second group 2' of conductors are then alongside the conductors of the first group 1.

Figure 2:
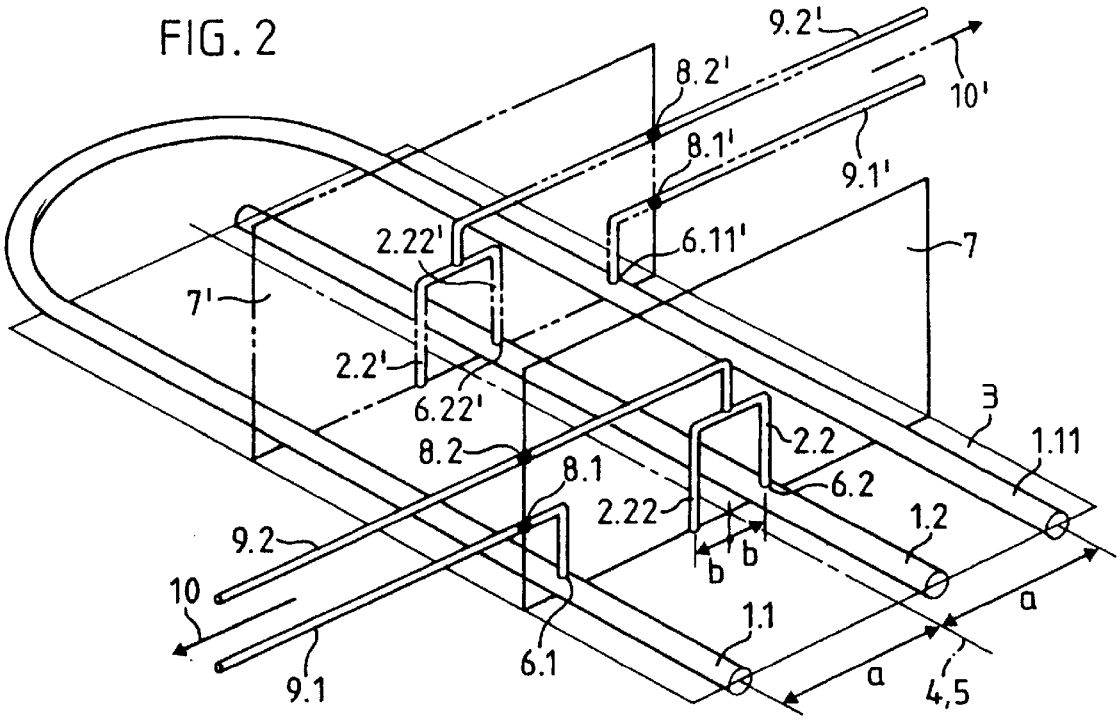
FIGS. 2, 3 and 4 are perspective views of contacting arrangements according to the invention.

FIG. 2 shows how the problem is solved by the contacting arrangement according to the invention. In order to permit two different contacting positions, conductors which are not located in one of the longitudinal axes 4 or 5 are double guided and electrically interconnected in at least one group 1 or 2 with the same spacing a or b from the particular longitudinal axis 4 or 5.

In the first group 1 e.g. the outer conductor 1.1 is double guided. The double guidance and electrical connection are preferably obtained by guiding one of the conductor in a loop, so that one part 1.1 of the conductor lies in plane 3 and is parallel to the first longitudinal axis 4 while its other part 1.11 returns in parallel to the first longitudinal axis 4. The spacings a between the double guided conductor branches 1.1 and 1.11 and the first longitudinal axis 4 are the same. One conductor branch 1.1 is contacted by means of a contact 6.1 and the other conductor branch 1.11 is "blind", i.e., is unused and therefore inactive.

In the second group 2 e.g. the inner conductor 2.2 is double guided. The spacings b between the double guided conductor branches 2.2 or 2.22 and the second longitudinal axis 5 are the same. One conductor branch 2.2 is connected by means of a contact 6.2 and the other conductor branch 2.22 is "blind".

The second group 2 of conductors is also shown in FIG. 2 in broken line form in another contacting position, which corresponds to a rotation by 180° from the first contacting position. Compared with the first contacting position is contacting and "blind" conductor branches are now interchanged. A connection through contacts 6.11' or 6.22' is ensured, because in each case the two conductor branches are electrically interconnected.

Figure 3:
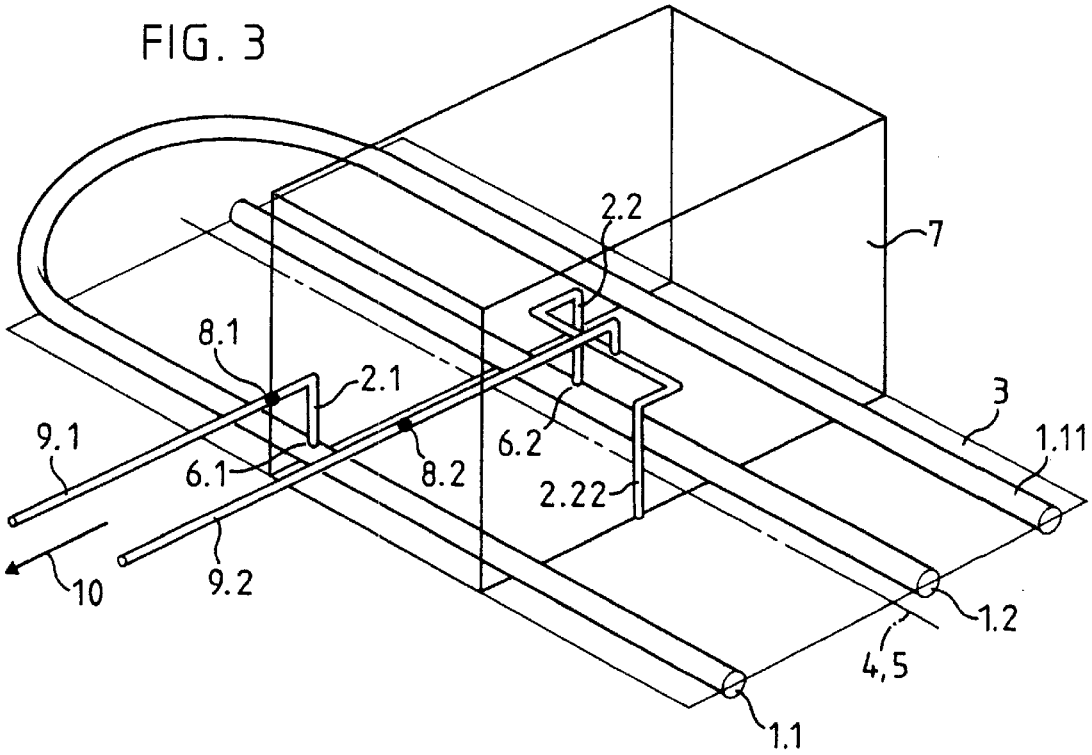

The ends of the conductors of the second group 2 are located in FIG. 2 on a straight line. By means of FIG. 3 it will be illustrated that this only represents a special case of the contacting arrangement according to the invention and is not a necessary condition for the functioning thereof. In the example of FIG. 3, the ends of the conductors of the second group 2 are displaced.

Figure 4:
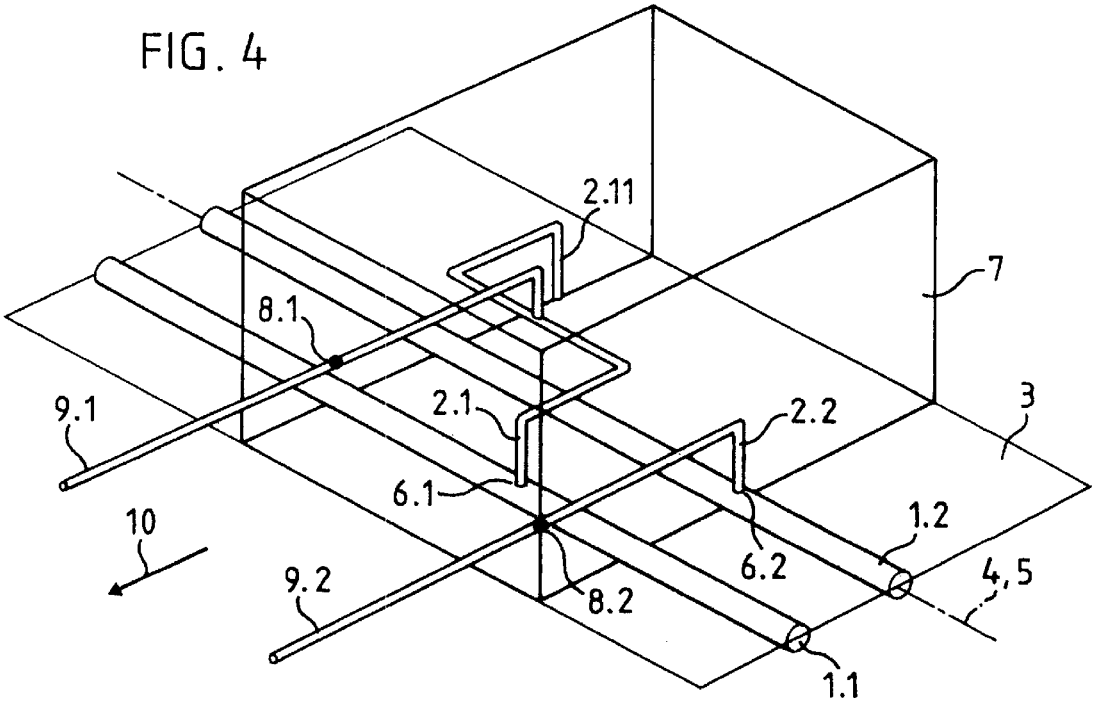

FIG. 4 deals with the special case, in which a conductor 1.2 of the first group 1 is coaxial with the first longitudinal axis 4 and the end of a conductor 2.2 of the second group 2 is located on the second longitudinal axis 5. This case is particularly advantageous, because the conductors 1.2 and 2.2 on the longitudinal axes 4 and 5 are connected in both contacting positions without having to be double guided.

Figure 5:
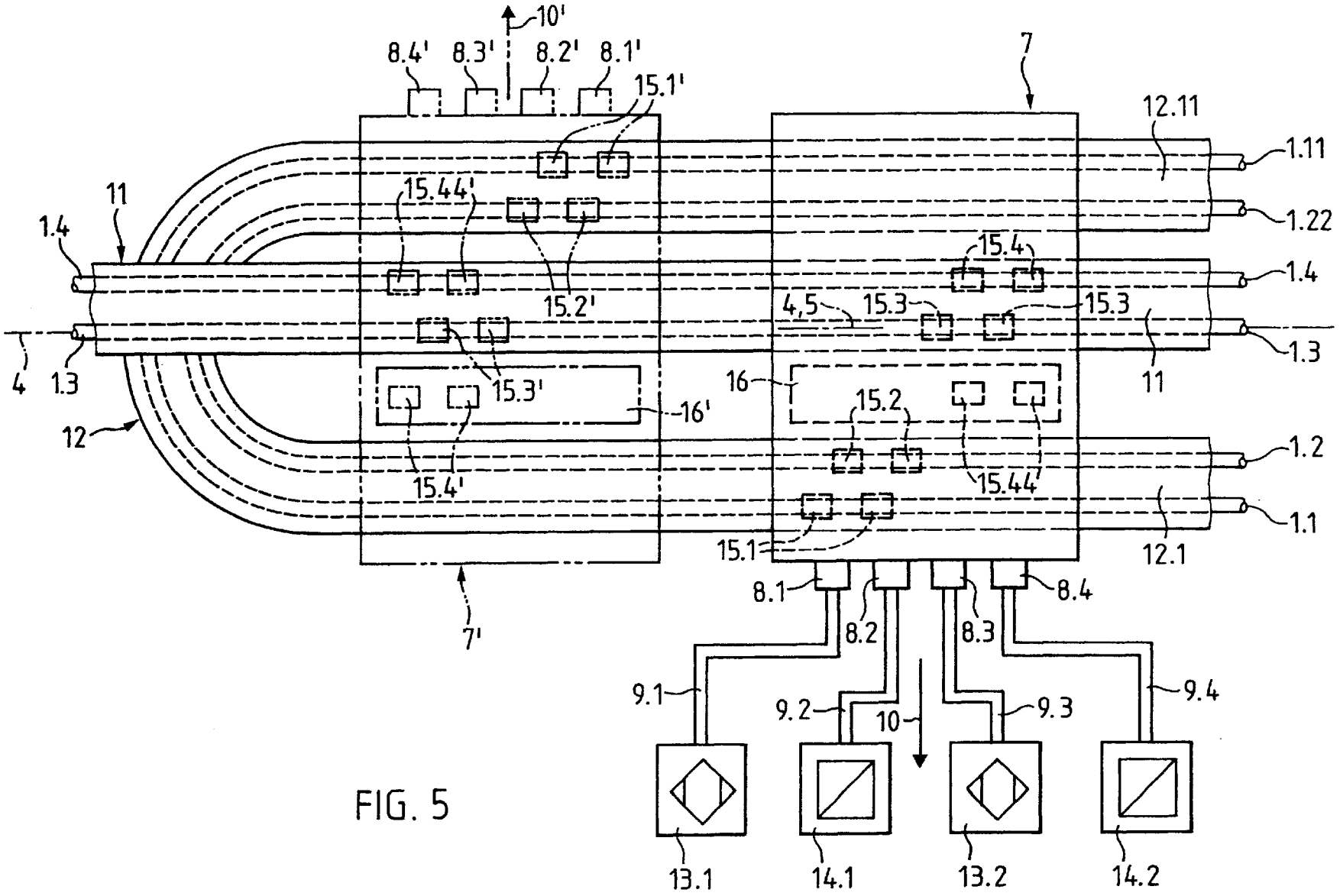
FIG. 5 is a schematic plan view of an exemplified embodiment of a contacting arrangement according to the invention.

FIG. 5 is a plan view of an embodiment of the contacting arrangement according to the invention. This example relates to the contacting of a bus cable 11 and a power supply cable 12 for the interconnection of sensors 13.1, 13.2 and/or actuators 14.1, 14.2. The conductors 1.1–1.4 of the first group 1 are housed in fixed, e.g. two-core, shaped flat cables, namely a bus cable 11 and a power supply cable 12. In this case the power supply cable 12, which has two conductors 1.1, 1.2, is guided in a loop and can consequently be subdivided into two conductor branches 12.1, 12.11. The bus cable 11 is so positioned that one of the two bus conductors 1.3, 1.4, namely the conductor 1.3, runs on the first longitudinal axis 4.

The second group 2 of conductors is housed in a movable coupling module 7, which can be fixed relative to the flat cables 11, 12. The coupling module 7 has contacting means 15.1–15.4 for the conductors 1.1–1.4 of the first group 1. The contacting means 15.1–15.4, 15.44 can be constructed as per se known cutting contacts with mandrels which, when coupling module 7 is pressed onto the cables 11, 12, penetrate through the cable insulations to the conductors 1.1–1.4. To improve contacting, each cutting contact can be present in multiple form, e.g. twice in FIG. 5. For the "blind" cutting contacts 15.44, which in a specific contacting position contact no conductors of the first group 1, dummy parts 16 made, for example, from rubber can be provided on the coupling module 7. The "blind" cutting contacts 15.44 can be embedded in these dummy parts 16, so that the watertightness of the contacting arrangement is ensured.

The coupling module 7 has connections 8.1–8.4 for the connecting cables 9.1–9.4. The connections 8.1–8.4 are preferably constructed as terminals. The connecting cables 9.1–9.4 lead to one or more sensors 13.1, 13.2 and/or actuators 14.1, 14.2. In the embodiment of FIG. 5 there are four connections 8.1–8.4 and connecting cables 9.1–9.4, which lead away essentially in a direction 10 perpendicular to the first longitudinal axis 4. FIG. 5 shows in broken line form the coupling module 7'in a second contacting position, in which the connections 8.1'–8.4' lead away in the opposition direction 10'.

Figure 6:
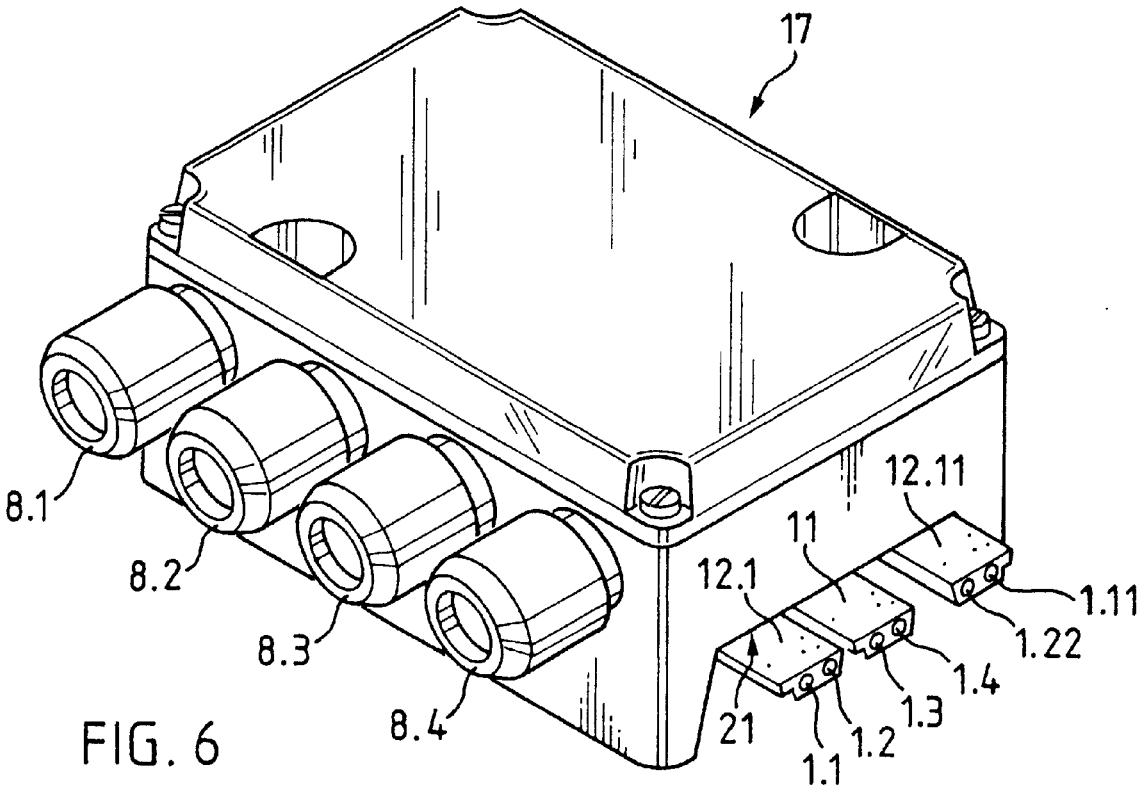
FIG. 6 is a perspective view of an upper part of a coupling module according to the invention.

The coupling module 7 preferably comprises a module upper part 17 and a module lower part 18. FIG. 6 is a perspective view of the module upper part 17, which mainly fulfills electrical functions. It contains the contacting means 15.1–15.4, 15.44, which are not visible in FIG. 6, because they are located on the underside 21 of the module upper part 17. The connections 8.1–8.4 for the connecting cables 9.1–9.4 are clearly visible. FIG. 6 also shows a bus cable 11 and a power supply cable 12, guided in two branches 12.1, 12.11, with in each case a substantially trapezoidal shape and in each case two conductors of the first group 1.

Figure 7:
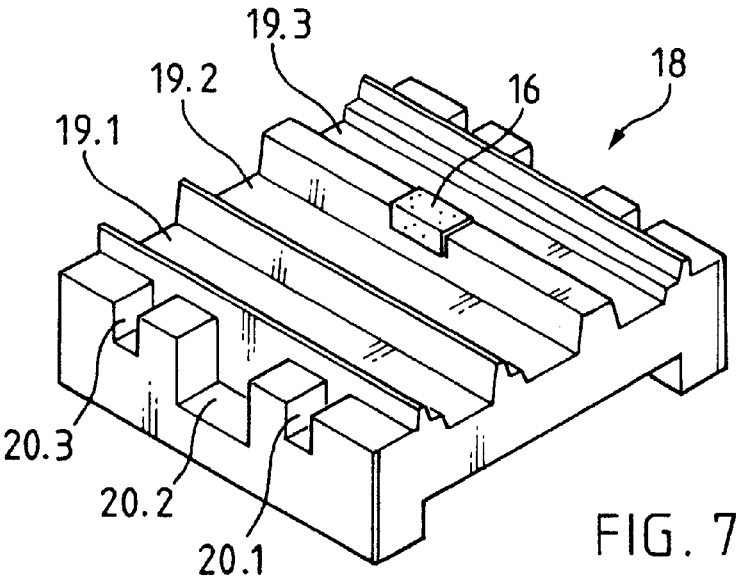
FIG. 7 is a schematic perspective view of a lower part of a coupling module according to the invention.

FIG. 7 is an inverted perspective view of the module lower part 18, which mainly fulfills mechanical functions. It contains first positioning means 19 for positioning the coupling module 7 on the flat cables 11, 12. These first positioning means are e.g. constructed as recessed channels 19.1–19.3 with shapes corresponding to the flat cables. The module lower part 18 also contains per se known, not shown fastening means for fastening the coupling module relative to the flat cable 11, 12. The fastening means are e.g. constructed as snap closures. Two positioning means 20.1–20.3 permit an exact positioning of the module upper part 17 on the module lower part 18.

The module lower part 18 can be provided with not shown means for fastening to a not shown hat or cap rail. For fitting purposes, firstly the module lower part 18 is fixed to the rail, then the flat cables 11, 12 are placed and fixed in the module lower part 18 and finally the module upper part 17 is positioned on the module lower part 18 with the second positioning means 20.1–20.3 and fixed by suitable means, e.g. screws.

It is pointed out that the coupling module 7 according to the invention can have a different construction to that shown in FIGS. 5 to 7. In particular, first positioning means 19.1–19.3, second positioning means 20.1–20.3, fastening means, contacting means 15.1–15.4, 15.44 and connections 8.1–8.4 can also be differently arranged on the coupling module 7. Obviously the contacting arrangement according to the invention can be used for purposes other than the here described interlinking of sensors 13.1, 13.2 and/or actuators 14.1, 14.2.

I claim:

1. A contacting apparatus for interconnecting first and second groups of conductors, the apparatus comprising a first group of conductors lying in a plane parallel with a longitudinal axis and including a first conductor spaced a first distance from said axis and a second conductor having a first portion spaced a second distance from said axis, said second distance being greater than said first distance and a second portion on an opposite side of said axis from said first portion and spaced from said axis by a distance equal to said second distance, said first and second portions of said first conductor being electrically connected together;

a connection module having a second longitudinal axis and contact points therein for making electrical connections with said conductors of said first group, said contact points including a first contact point spaced from said second longitudinal axis by a distance equal to one of said first and second distances, and second and third contact points on opposite sides of said second longitudinal axis and spaced from said second axis by equal distances equal to the other of said first and second distances, a second group of conductors including a third conductor electrically connected to said first contact point and a fourth conductor electrically connected to both of said second and third contact points; and mechanical means for coupling said connection module to said first group of conductors with said first and second axes substantially aligned in either of two positions separated by 180°, with said first contact point making an electrical connection with one of said first and second conductors and one of said second and third contact points making an electrical connection with the other of said first and second conductors in either of said positions.

2. An apparatus according to claim 1 wherein said conductors of said first group are covered with insulation material and said contact points comprise sharp metal points for penetrating said insulation when said connection module is coupled to said first group of conductors.

3. An apparatus according to claim 1 wherein said first and second portions of said second conductor comprise a single conductor with a loop between said first and second portions.

4. An apparatus according to claim 1 wherein said conductors of said first group comprise a fixed, multiconductor flat cable.

5. An apparatus according to claim 4 wherein said conductors of said first group comprise a fixed, two-conductor flat cable.

6. An apparatus according to claim 4 wherein said first and second groups of conductors comprises a bus cable for transmitting data and electrical power.

7. An apparatus according to claim 4 wherein said first and second groups of conductors include a power cable.

8. An apparatus according to claim 1 wherein said first group comprises a bus cable having a plurality of conductors, one of said conductors being coaxial with said first longitudinal axis, and a power supply cable forming a loop.

9. An apparatus according to claim 1 wherein said connection module is movable and wherein said mechanical means includes means for engaging said conductors.

10. An apparatus according to claim 9 wherein said contact points comprise cutting contacts for making contact with said conductors.

11. An apparatus according to claim 10 wherein each of said contact points comprises a plurality of cutting contacts for improving electrically conductive contact.

12. An apparatus according to claim 10 wherein said connection module comprises dummy parts for engaging contact points not connected to electrical conductors to close openings in said module.

13. An apparatus according to claim 1 wherein said connection module comprises an upper housing part and a lower housing part.

14. An apparatus according to claim 13 wherein said mechanical means comprises shaped recesses in said lower housing part for mating with said conductors of said first group of conductors.

15. An apparatus according to claim 14 wherein said upper housing part comprises connectors for connecting said second group of conductors to said contact points and means for carrying said contact points.

16. An apparatus according to claim 14 wherein said upper housing part includes means for leading said second group of conductors away from said first group in a direction substantially perpendicular to said first longitudinal axis.

17. An apparatus according to claim 16 wherein said second group of conductors are connected to sensor and actuators.

* * * * *